US008746770B2

(12) United States Patent
Sladojevic

(10) Patent No.: US 8,746,770 B2
(45) Date of Patent: Jun. 10, 2014

(54) CONCRETE LIFTING ANCHORS

(76) Inventor: Robert Sladojevic, Cherry Gardens (AU)

( * ) Notice: Subject to any disclaimer, the term of this patent is extended or adjusted under 35 U.S.C. 154(b) by 0 days.

(21) Appl. No.: 13/806,193

(22) PCT Filed: Jun. 30, 2010

(86) PCT No.: PCT/AU2010/000831

§ 371 (c)(1),
(2), (4) Date: Dec. 21, 2012

(87) PCT Pub. No.: WO2011/006189

PCT Pub. Date: Jan. 20, 2011

(65) Prior Publication Data

US 2013/0119686 A1 May 16, 2013

(51) Int. Cl.
*B66F 19/00* (2006.01)

(52) U.S. Cl.
USPC ..... 294/215; 52/125.4

(58) Field of Classification Search
USPC ..... 294/215, 82.1, 901, 92; 52/125.4, 52/125.2, 125.5
See application file for complete search history.

(56) References Cited

U.S. PATENT DOCUMENTS

| | | | | |
|---|---|---|---|---|
| 7,934,343 | B2 * | 5/2011 | Fletcher et al. | 52/125.5 |
| 8,096,086 | B2 * | 1/2012 | Fletcher | 52/125.4 |
| 2013/0091785 | A1 * | 4/2013 | Sladojevic | 52/125.4 |
| 2013/0139451 | A1 * | 6/2013 | Sladojevic | 52/125.4 |

FOREIGN PATENT DOCUMENTS

| | | | | |
|---|---|---|---|---|
| AU | 2006201337 | A1 | 10/2006 | |
| EP | 281545 | A2 * | 9/1988 | E04G 21/14 |

* cited by examiner

*Primary Examiner* — Saul Rodriguez
*Assistant Examiner* — Gabriela Puig

(57) ABSTRACT

A tension bar for an edge lift anchor for a concrete panel, the tension bar being shaped to provide a central portion to lie adjacent a head portion of the anchor and legs extending from each end of the central portion, an inner side of each leg being profiled to lock into the surrounding concrete, the profiling being formed by a series of longitudinally spaced formations each of generally saw-toothed shape with a leading edge of each formation facing towards the head portion such that on application of tensile load to the tension bar, the leg will lock into the concrete with a generally compressive loading being applied to the concrete in the zone between the two legs.

6 Claims, 3 Drawing Sheets

CONCRETE LIFTING ANCHORS

BACKGROUND OF THE INVENTION

The present invention relates to anchors for use in the lifting of cast concrete products such as wall panels during the erection thereof. More particularly the invention relates to edge lift anchors.

In the fabrication of precast concrete wall panels either at an offsite casting yard or onsite, it is necessary to lift the panel from the horizontal configuration in which it is cast to a vertical configuration for transportation and/or erection. For offsite casting and for some onsite casting, lifting of the panel takes place from the edge of the panel which is the upper edge in the erected condition of the panel. For this purpose so-called edge lift anchors are incorporated into the reinforcing structure of the panel prior to casting. During casting the head of the anchor is encased within a removable or disposable void former to form within the edge surface of the panel a recess within which the head of the anchor lies for releasable coupling to lifting equipment.

Various forms of edge lift anchor are currently available. When the panel is being lifted when in its vertical configuration, the edge lift anchors must take the entire weight of the panel and edge lift anchors are appropriately sized for this purpose. Typically, the anchors are produced in a range of load carrying capacities from 2 tonne to 10 tonne, with anchors of appropriate capacity being selected for each particular job. For an anchor of given type and size, its load carrying capacity can be increased by the incorporation of an aperture beneath the head of the anchor to receive a tension bar which, conventionally, is a length of reinforcing bar which passes through the aperture and is bent to provide extending legs on either side of the body of the anchor to increase its effective depth of embedment relative to the upper edge of the panel. In a conventional tension bar, the loading is carried by the frictional forces between the bar and the concrete and for this reason, the legs of conventional tension bars tend to be of substantial length.

BRIEF SUMMARY OF THE INVENTION

The present invention relates to a tension bar with improved capacity for locking into the surrounding concrete.

According to the invention there is provided a tension bar for an edge lift anchor for a concrete panel, the tension bar being shaped to provide a central portion to lie adjacent a head portion of the anchor and legs extending from each end of the central portion, an inner side of each leg being profiled to lock into the surrounding concrete, the profiling being formed by a series of longitudinally spaced formations each of generally saw-toothed shape with a leading edge of each formation facing towards the head portion such that on application of tensile load to the tension bar, the leg will lock into the concrete with a generally compressive loading being applied to the concrete in the zone between the two legs.

In one embodiment of the invention the tension bar is engaged with a collar applied to the head of the edge lift anchor. In an alternative embodiment specifically applicable to an anchor with parallel legs configured to provide a compressive loading between the legs when under loading, there is no physical engagement between the anchor and the tension bar but the tension bar lies inwardly of the head and as a result of the compressive loading applied to the concrete between the two legs of the anchor, the tension bar will interlock with the anchor via the concrete held under compression.

BRIEF DESCRIPTION OF THE SEVERAL VIEWS OF THE DRAWINGS

An embodiment of the invention will now be described by way of example only with reference to the accompanying drawings in which.

DETAILED DESCRIPTION OF THE INVENTION

Figure 1:
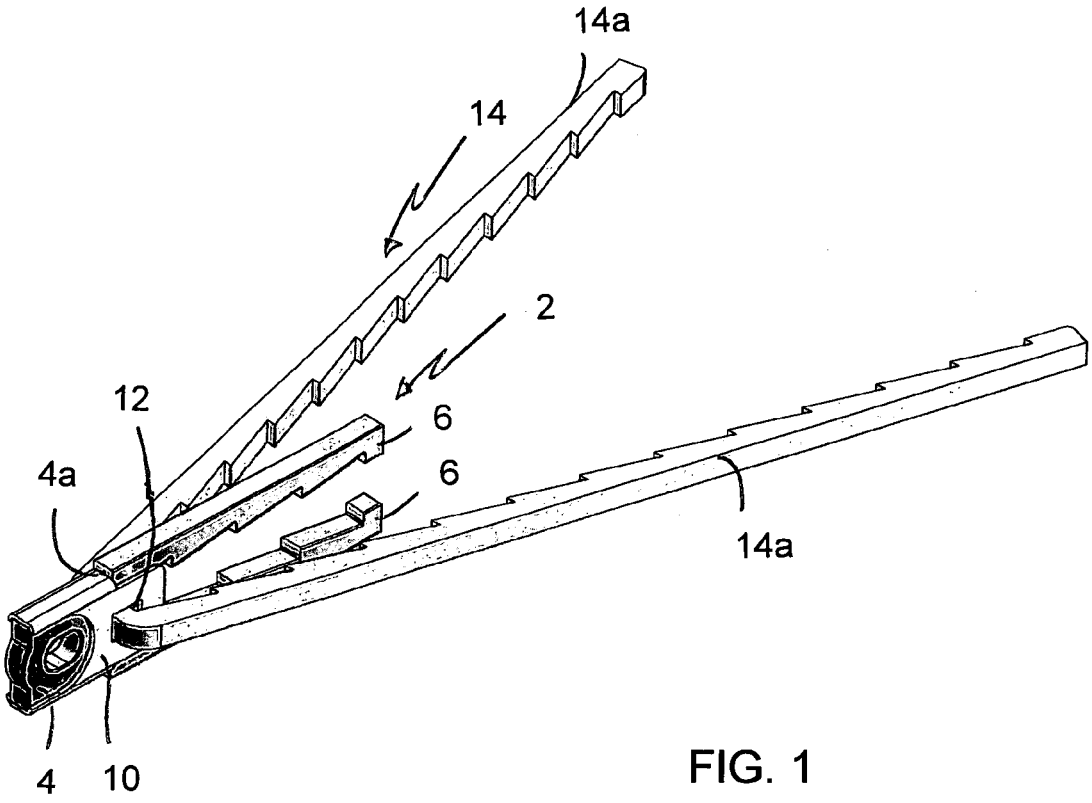
FIG. 1 is a perspective view showing an edge lift anchor with a tension bar in accordance with the invention installed thereon.
Figure 2:
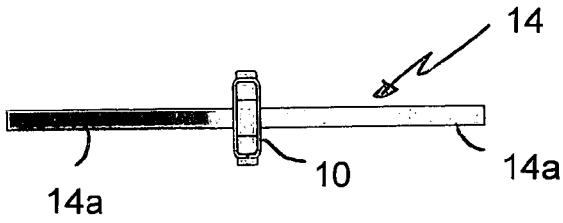
FIG. 2 is an end view.
Figure 3:
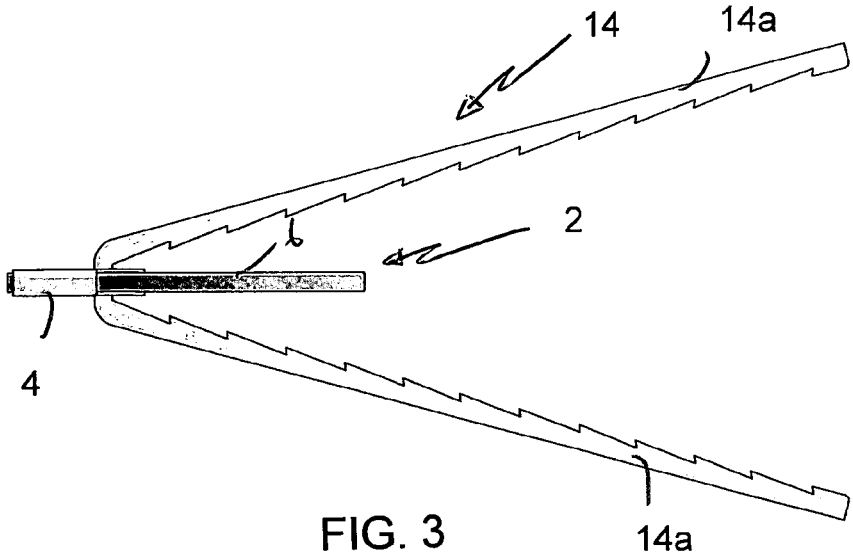
FIG. 3 is a plan view.
Figure 4:
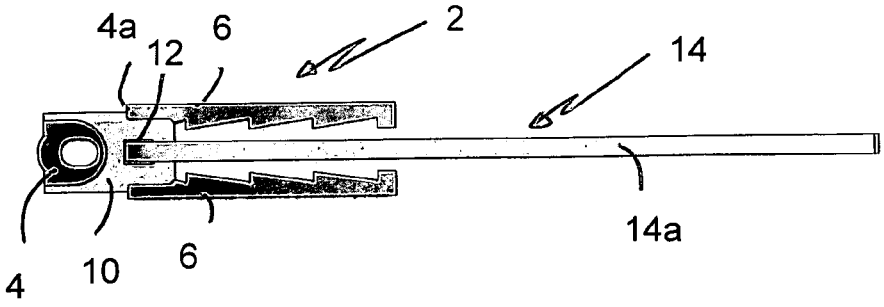
FIG. 4 is a side view.

FIGS. 1 to 4 show an edge lift anchor 2 in its installed position for lifting of the panel from its casting configuration in which the upper face of the panel is horizontal. The anchor has a head 4 for coupling to lifting apparatus, and an anchoring portion in the form of a pair of substantially parallel legs 6 extending from the head 4. The particular head 4 shown is designed for cooperation with a lifting clutch in the form of a ring clutch and an arcuate locking bolt received within the eye of the head, although it is to be understood that the head could be of a different detailed design for use with other types of lifting apparatus. The legs 6 are profiled along their inner edges with a saw tooth profile so as to lock into the surrounding concrete but it is to be understood that the legs may have any other form of profile to achieve that purpose and the anchoring portion may be even be of a form which does not use two parallel legs.

In the embodiment illustrated in which the legs 6 are profiled along their inner edges with a saw-tooth profile, it is preferred that the detailed profile is as described in patent application 2006201337 the disclosure which is incorporated by reference. As disclosed in that application the profiling is formed by a series of formations of saw-tooth like shape with the leading face thereof which represents the locking portion facing towards the head of the anchor. That leading face is inclined towards the head such that on application of a pulling load to the head the formations will cause the leg to lock tighter into the concrete with increasing load and will not deflect laterally outwardly under the effect of forces acting on the formations when under load. In practice, the inclination of the leading edges of the saw-tooth formations will apply a laterally inwards force to each of the two legs whereby the concrete between the two legs will be under a compressive loading.

The anchor of the general type shown with parallel legs or of other forms without parallel legs is formed from thick metal plate by cutting and/or pressing techniques as will be well understood by persons skilled in the art. It is orientated in the panel in its casting configuration with an upper edge substantially parallel to the upper face of the panel. In the embodiment shown, the head 4 of the anchor is stepped inwardly relative to the anchoring portion, the step being designated 4*a* in the drawings. A shear bar (not shown) engages the upper edge of the head 4 adjacent the step 4*a*.

The anchor of the general type shown is formed from thick metal plate by cutting and/or pressing techniques as will be well understood by persons skilled in the art. It is orientated in the panel in its casting configuration with an upper edge substantially parallel to the upper face of the panel. In the embodiment shown, the head 4 of the anchor is stepped inwardly relative to the anchoring portion, the step being designated 4*a* in the drawings. A shear bar (not shown) engages the upper edge of the head 4 adjacent the step 4*a*.

Figure 5:
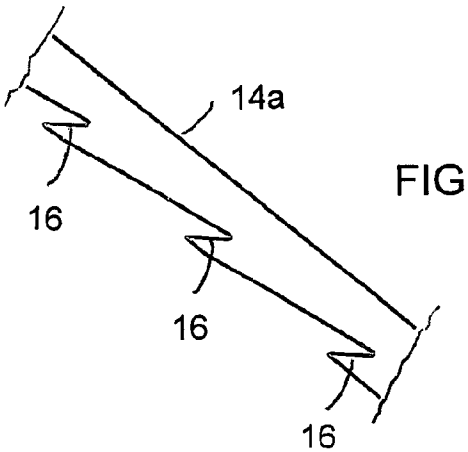
FIG. 5 is a fragmentary view similar to FIG. 3 and to an enlarged scale to better illustrate the detail of the locking formations of the tension bar.

The head 4 carries a metal collar 10 which is formed separately from the anchor and is applied to the head following manufacture of the anchor. The collar 10 incorporates an aperture 12 inwardly of the eye of the head 4 and thus beneath the eye in the lifting configuration of the anchor. The aperture 12 is designed to receive a metal tension bar 14 which is of a rectangular cross-section. It will be noted that the inner surface of each of the inclined or divergent legs 14*a* of the tension bar is formed with saw-tooth profiling which is similar to that of the legs 6 of the anchor and is configured to operate in fundamentally the same way. In particular and with reference to FIG. 5, each of the saw-toothed formations has a leading edge 16 inclining towards the head of the tension bar 14 where the bar extends through the aperture 12 so that when tension is applied to the bar when the panel is being raised, the saw-toothed formations will lock more tightly into the concrete. The inter-action between the legs 14*a* and the concrete as a result of these formations creates a laterally inwards force whereby the concrete in the zone between the two legs is subject to a compressive loading. Due to this compressive loading, strong anchorage is achieved between the legs of the bar and the concrete. This provides significant advantages. For a required load bearing capacity the bar can be smaller and lighter than a conventional tension bar. Further, although conventional tension bars enable the panel to be lifted before it has cured to full strength, the tension bar of the preferred embodiment enables, by virtue of the compressive loading, the panel to be lifted at lower part-cured strength; thereby the panel can be lifted earlier following casting, thus providing for improved efficiency for both off-site and on-site casting.

The incorporation of the collar 10 with the aperture for the tension bar enables an anchor of basic form without the collar to be converted to an anchor of increased lifting capacity by application of the collar following manufacture and thereby the same anchor can be used for a range of different load applications either with or without the presence of the collar. It is to be understood in this regard that the collar also enables lifting anchors of a basic design that does not facilitate the presence of an aperture for a tension bar, to carry a tension bar. Moreover the length of the collar and thereby the position of the aperture can be varied to permit variation in the positioning of the tension bar in the length direction of the anchor.

Figure 6:
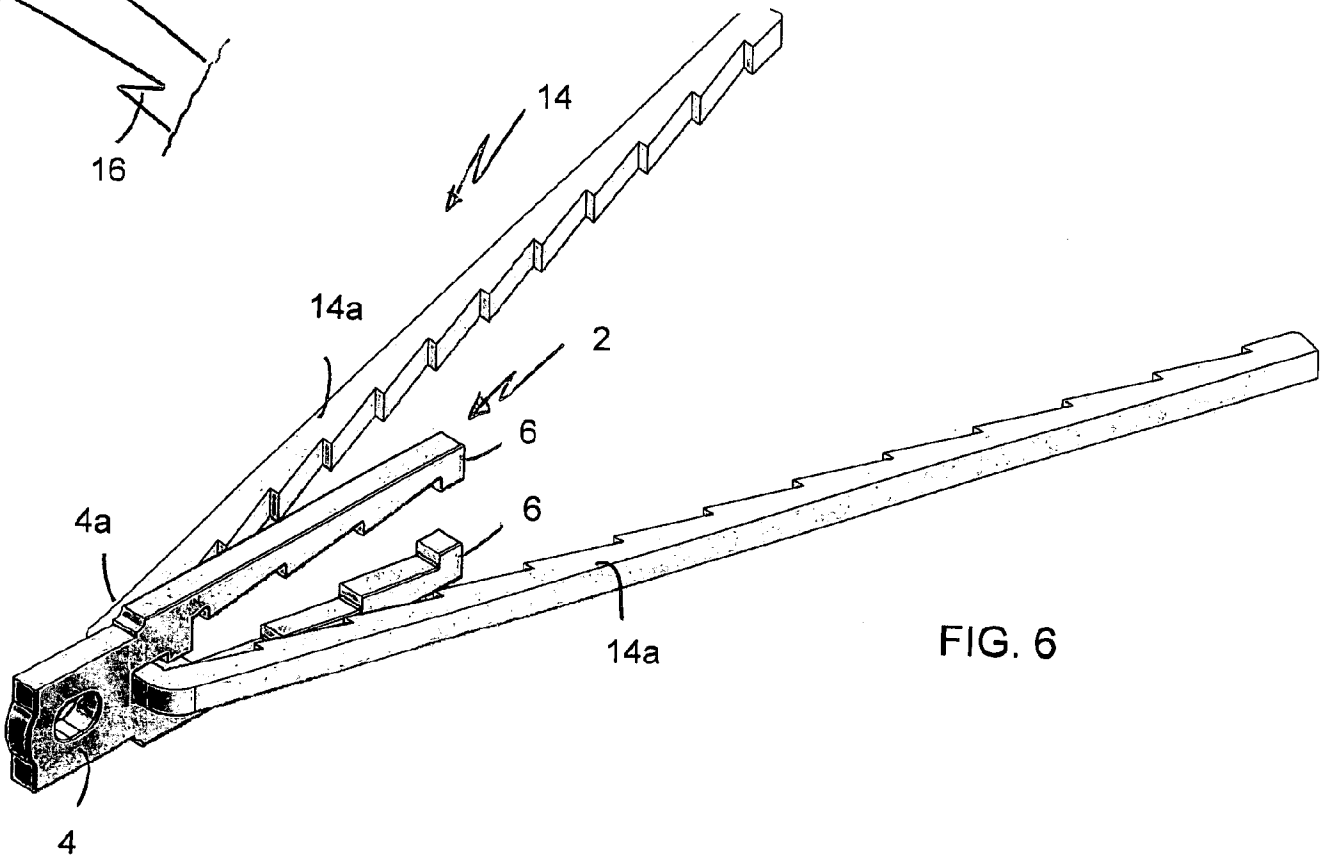
FIG. 6 is a view similar to FIG. 1 but having a different relationship between the tension bar and head of the anchor.

In the variant as shown in FIG. 6, the head of the tension bar 14 does not physically engage the head 4 of the anchor but lies inwardly of the head. As a result of the compressive loading applied to the concrete between the two legs 6 of the anchor as a result of their saw-toothed profiling, the tension bar 14 will effectively interlock with the anchor via the concrete held under compression.

The embodiments are described by way of example only and modifications are possible within the scope of the invention.

The invention claimed is:

1. A tension bar for an edge lift anchor for a concrete panel, the tension bar being shaped to provide a central portion to lie adjacent a head portion of the anchor and legs extending from each end of the central portion, an inner side of each leg being profiled to lock into the surrounding concrete, the profiling being formed by a series of longitudinally spaced formations each of generally saw-toothed shape with a leading edge of each formation facing towards the head portion such that on application of tensile load to the tension bar, the leg will lock into the concrete with a generally compressive loading being applied to the concrete in the zone between the two legs.

2. A tension bar according to claim 1, wherein the tension bar is of rectangular cross-section.

3. A tension bar according to claim 1, wherein the legs diverge from the central portion.

4. In combination an edge lift anchor comprising a head portion for coupling to lifting apparatus and an anchoring portion extending from the head portion, and a tension bar according to claim 1, the central portion of the bar being engageable with the anchor.

5. A combination according to claim 4, wherein a collar is applied to the head portion of the anchor, the collar including an aperture for receipt of a central portion of a shear bar.

6. A combination according to claim 5, wherein the anchoring portion of the anchor comprises substantially parallel legs and the aperture in the collar for receiving the central portion of the tension bar is between the legs.

* * * * *